US012553253B2

(12) United States Patent
Ruzic et al.

(10) Patent No.: US 12,553,253 B2
(45) Date of Patent: Feb. 17, 2026

(54) ROOFTOP TENT ASSEMBLY

(71) Applicant: Intrepid Camp Gear LLC, Boulder, CO (US)

(72) Inventors: Edward J. Ruzic, Boulder, CO (US); SooYoung Baik, Ho Chi Minh (VN); KyoungGuk Shin, Seoul (KR)

(73) Assignee: INTREPID CAMP GEAR LLC, Boulder, CO (US)

( * ) Notice: Subject to any disclaimer, the term of this patent is extended or adjusted under 35 U.S.C. 154(b) by 195 days.

(21) Appl. No.: 18/201,124

(22) Filed: May 23, 2023

(65) Prior Publication Data

US 2023/0349190 A1 Nov. 2, 2023

Related U.S. Application Data

(60) Provisional application No. 63/322,750, filed on Mar. 23, 2022.

(51) Int. Cl.
*E04H 15/06* (2006.01)
*E04H 15/00* (2006.01)
*E04H 15/48* (2006.01)

(52) U.S. Cl.
CPC ..... *E04H 15/06* (2013.01); *E04H 15/008* (2013.01); *E04H 15/48* (2013.01)

(58) Field of Classification Search
CPC ..... E04H 15/06; E04H 15/48; E04H 15/008
See application file for complete search history.

(56) References Cited

U.S. PATENT DOCUMENTS 3,454,020 A † 7/1969 Grossman
3,763,607 A * 10/1973 Glover ..... E04H 15/06 135/88.13
9,222,278 B2 12/2015 Park
9,567,767 B2 2/2017 Kendrick
9,580,928 B1 2/2017 Currid
10,125,517 B2 11/2018 Xu
10,465,412 B1 11/2019 Currid
(Continued)

FOREIGN PATENT DOCUMENTS

FR 3096065 A1 * 11/2020 ..... E04B 1/3445
KR 20190048763 A * 5/2019
WO 2021185102 A1 † 9/2021

*Primary Examiner* — David R Dunn
*Assistant Examiner* — Danielle Jackson
(74) *Attorney, Agent, or Firm* — David E. Crawford; Fast Forward Law, LLC

(57) ABSTRACT

A shelter assembly a flat base having a first rim section, a second rim section, and opposite side rim sections extending between the first and second rim sections. The assembly includes a rigid lower panel having a lower edge, an upper edge, and opposite side edges. The lower edge is pivotably connected to the first rim section for movement between a closed orientation and an open orientation. The shelter assembly includes a rigid upper panel having a first end, a second end, and opposite sides. The first end is pivotably connected to the upper edge for pivoting movement relative to the lower panel between a closed configuration and an open configuration. Each side panel extends between one side edge of the lower panel, one corresponding side of the upper panel, and one corresponding side rim section and the one side of the upper panel.

20 Claims, 9 Drawing Sheets

(56) References Cited

U.S. PATENT DOCUMENTS

| | | | | |
|---|---|---|---|---|
| 10,543,771 | B2 | 1/2020 | Sautter et al. | |
| 10,590,675 | B2 * | 3/2020 | Zhou | E04H 15/008 |
| 10,745,932 | B1 | 8/2020 | Currid | |
| 10,753,120 | B2 | 8/2020 | Reeder et al. | |
| 11,203,279 | B1 | 12/2021 | Tatro | |
| 11,346,123 | B2 | 5/2022 | Park | |
| 11,660,997 | B2 | 5/2023 | Davis | |
| 11,753,844 | B2 | 9/2023 | Dunn et al. | |
| 2014/0251401 | A1 | 9/2014 | Barber | |
| 2018/0112432 | A1 | 4/2018 | Xu | |
| 2022/0289096 | A1 | 9/2022 | Wu | |
| 2023/0264621 | A1 * | 8/2023 | Wang | B60P 3/38 |
| 2023/0279691 | A1 * | 9/2023 | Tsao | E04H 15/10 135/88.13 |

* cited by examiner
† cited by third party

ROOFTOP TENT ASSEMBLY

CROSS-REFERENCE TO RELATED APPLICATION

The present application claims benefit of U.S. Provisional Patent Application No. 63/322,750 entitled, "Rooftop Tent Assembly" filed Mar. 23, 2022, which is hereby incorporated by reference in its entirety.

BACKGROUND

The present disclosure relates to a rooftop tent assembly or shelter assembly adapted for mounting on a vehicle roof rack, and more specifically, a rooftop tent having a hinged hard shell forming a roof and an end wall of the shelter assembly.

Rooftop tents offer users an alternative to ground camping that provides a greater sense of comfort, security, and mobility. These tents fall into two broad design categories—hard shell tents and soft shell tents. Hard shell tents have a rigid case or hard shell mounted on a base or platform. When opened, the hard shell forms part of the shelter covering the base. When closed, the hard shell and base form a rigid container for storage or travel. Soft shell tents consist of fabric or other flexible sheet material (broadly, flexible tent materials) supported by a frame assembly mounted on a base. Although soft shell rooftop tents are less expensive and provide greater comfort than ground tents, they are less durable than hard shell tents. Users who want a tent that will last longer, assemble quickly, and be more resistant to weather usually prefer hard shell tents, which are available in two design types.

The first design type is a box-shaped design, in which the hard shell top moves upward away from the base to form a flat roof when opened. A support frame positioned between edges of the roof and base allows the shell to raise quickly and with little effort. Four fabric sides extend downward from the edges of the roof to the base. The resulting rectangular box shape provides users uniform headroom and a large livable space but leaves the users susceptible to weather on all four fabric sides. The fabric sides are water resistant, and the hard shell completely blocks wind and water. Box-shaped tents are quick to set up but closing or dismantling the tents can be time consuming. As the user lowers the hard shell to close the tent, the interior volume decreases, forcing air inside the tent outward and causing the fabric sides to balloon beyond the shell and base. Before securing the shell to the base for travel, a user must lift each side of the hard shell and stuff the fabric between the shell and base. Stuffing the fabric into the container results in the fabric crumpling inside the container, which deteriorates the fabric over time. The lengthy stuffing process and crumpled fabric storage are particularly problematic given that users choose these tents for their durability and quick setup and dismantling. For users who move camp often, these drawbacks are particularly problematic.

The second design type of hard shell tent is a clamshell or wedge-shaped design. Clamshell tents have a hinge connecting one edge of the hard shell to the base, so the hard shell pivots upward to form a sloped hard shell roof. This design has three fabric sides instead of four. Because the hard shell remains adjacent to the base when the tent is set up, the user spends less time stuffing fabric when dismantling clamshell tents compared to box-shaped tents. Further, the roof of the clamshell design effectively creates a hard side panel offering more protection from weather on that side panel. However, the clamshell design causes a restricted height along the hinged edge of the roof. The restricted height renders the hinged side of the tent nearly useless, resulting in far less livable space than box-shaped tents. Accordingly, when deciding which hard shell design type to buy, the user must choose between having less protection from weather or having reduced livable space for sleeping and storing equipment and supplies.

Thus, there remains a need for a hard shell tent that protects a user from weather without limiting livable space and reduces fabric crumpling during storage.

SUMMARY

In one aspect, the present disclosure includes a shelter assembly, comprising a rigid, generally flat base having a first rim section, a second rim section opposite the first rim section, and opposite side rim sections extending between the first rim section and the second rim section. The assembly also includes a rigid lower panel having a lower edge, an upper edge opposite the lower edge, and opposite side edges extending between the lower edge and the upper edge. The lower edge is pivotably connected to the first rim section of the base for movement between a closed orientation in which the upper edge is positioned adjacent the base and an open orientation in which the upper edge is spaced from the base. Further, the shelter assembly comprises a rigid upper panel having a first end, a second end opposite the first end, and opposite sides extending between the first end and the second end. The first end is pivotably connected to the upper edge of the lower panel for pivoting movement relative to the lower panel between a closed configuration in which the upper panel and the lower panel are generally coplanar and an open configuration in which the upper panel is oriented at an angle of less than about 180 degrees relative to the lower panel. In addition, the shelter assembly includes a pair of side panels. Each side panel of the pair of side panels extending between one side edge of the pair of side edges of the lower panel, one side of the pair of sides of the upper panel corresponding to the one side edge of the lower panel, and one side rim section of the pair of side rim sections corresponding to the one side edge of the lower panel and the one side of the upper panel.

In another aspect, the present disclosure includes a shelter assembly, comprising a rigid, generally flat base having a first rim section, a second rim section opposite the first rim section, and opposite side rim sections extending between the first rim section and the second rim section. In addition, the shelter assembly includes a rigid wall having a lower edge, an upper edge opposite the lower edge, and opposite side edges extending between the lower edge and the upper edge. The lower edge is pivotably connected to the first rim section of the base for movement between a closed orientation in which the upper edge is positioned adjacent the base and an open orientation in which the upper edge is spaced from the base. The assembly further comprises a rigid roof having a first end, a second end opposite the first end, and opposite sides extending between the first end and the second end. The first end is pivotably connected to the upper edge of the wall for pivoting movement relative to the wall between a closed configuration in which the roof and the wall are generally coplanar and an open configuration in which the second end of the roof is spaced from the base. The shelter assembly also includes a pair of side panels comprising tent material. Each side panel of the pair of side panels extends between one side edge of the pair of side edges of the wall, one side of the pair of sides of the roof corresponding to the one side edge of the wall, and one side rim section of the pair of side rim sections corresponding to the one side edge of the wall and the one side of the roof. The Moreover, the shelter assembly includes an end panel comprising tent material. The end panel extends between the second end of the roof, the second rim section of the base and the pair of side panels.

In yet another aspect, the present disclosure includes a shelter assembly, comprising: a rigid, generally flat base having a first rim section, a second rim section opposite the first rim section, and opposite side rim sections extending between the first rim section and the second rim section; a rigid wall having a lower edge, an upper edge opposite the lower edge, and opposite side edges extending between the lower edge and the upper edge, the lower edge is pivotably connected to the first rim section of the base for movement between a closed orientation in which the upper edge is positioned adjacent the base and an open orientation in which the upper edge is spaced from the base; a rigid roof having a first end, a second end opposite the first end, and opposite sides extending between the first end and the second end, the first end being pivotably connected to the upper edge of the wall for pivoting movement relative to the wall between a closed configuration in which the roof and the wall are generally coplanar and an open configuration in which the first end of the roof is elevated above the base by a first distance and the second end of the roof is elevated above the base by a second distance; and a pair of side panels, each side panel of the pair of side panels extending between one side edge of the pair of side edges of the wall, one side of the pair of sides of the roof corresponding to the one side edge of the wall, and one side rim section of the pair of side rim sections corresponding to the one side edge of the wall and the one side of the roof.

Other aspects of the present disclosure will be apparent in view of the following description and claims.

BRIEF DESCRIPTION OF DRAWINGS

This disclosure includes non-limiting examples illustrated in the accompanying drawings.

Corresponding reference characters indicate corresponding parts throughout the drawings.

DETAILED DESCRIPTION

Figure 1:
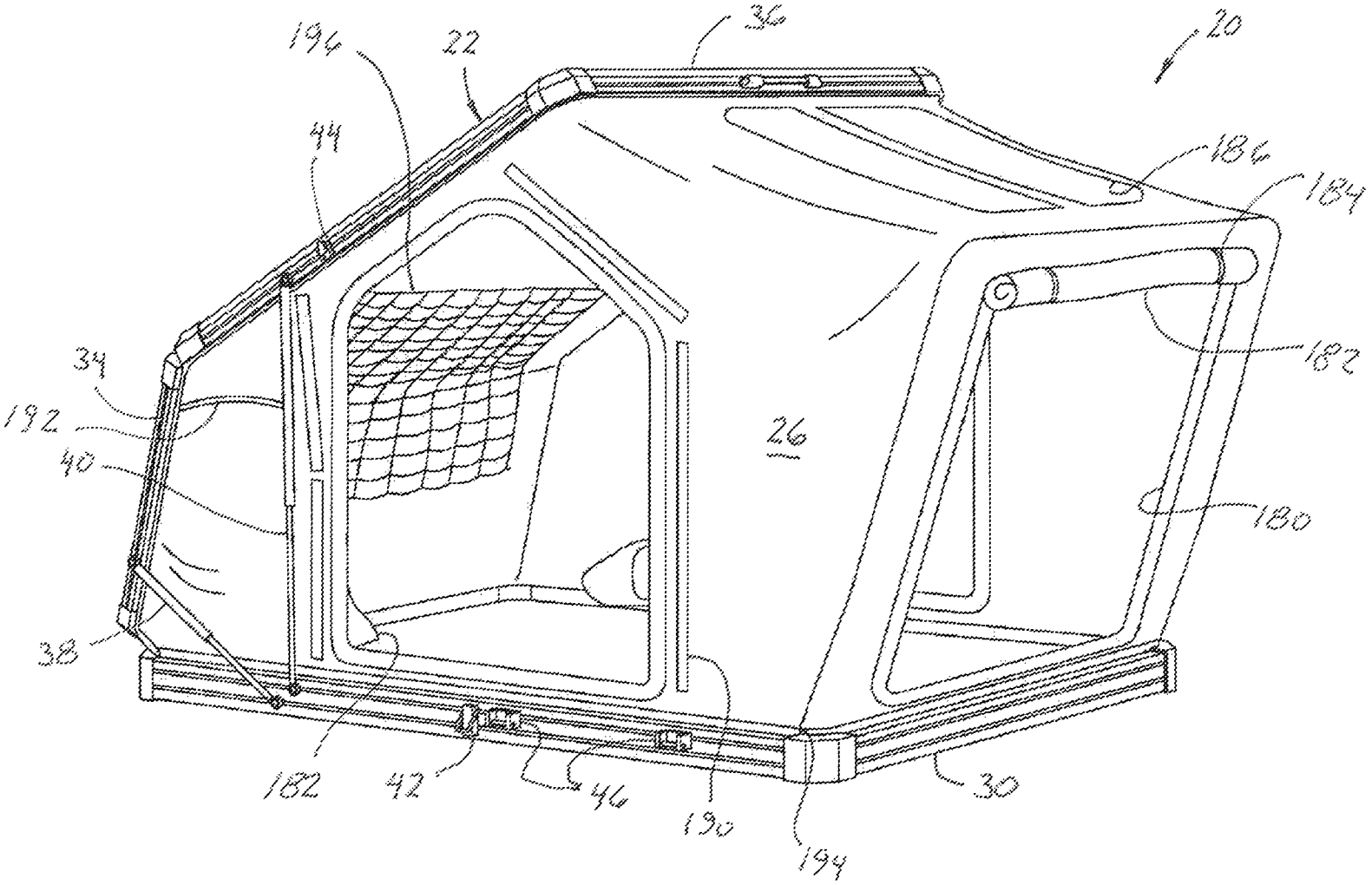
FIG. 1 is a perspective of an example of a rooftop tent described below.
Figure 2:
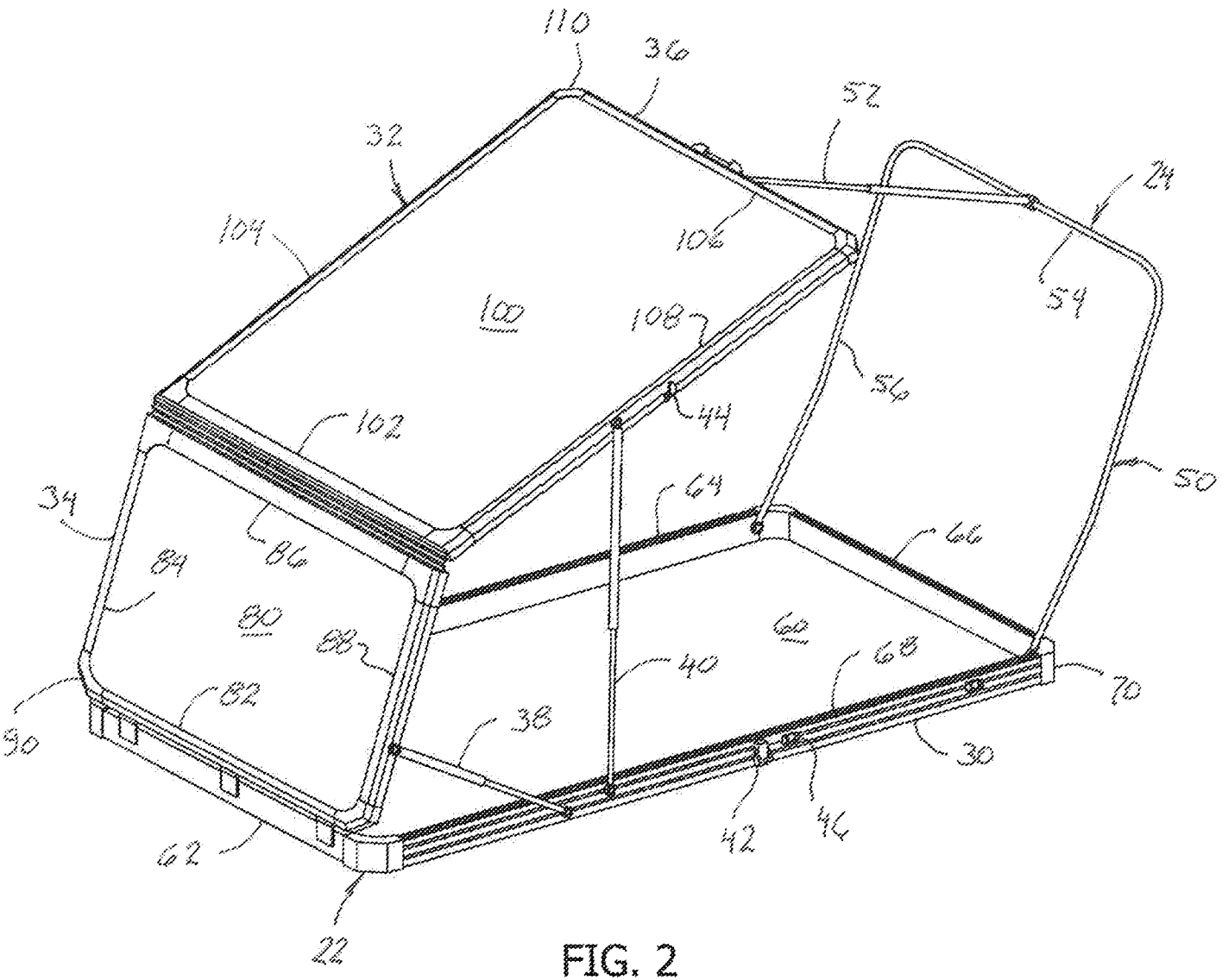
FIG. 2 is a perspective of rooftop tent of FIG. 1 shown without a fabric enclosure.
Figure 3:
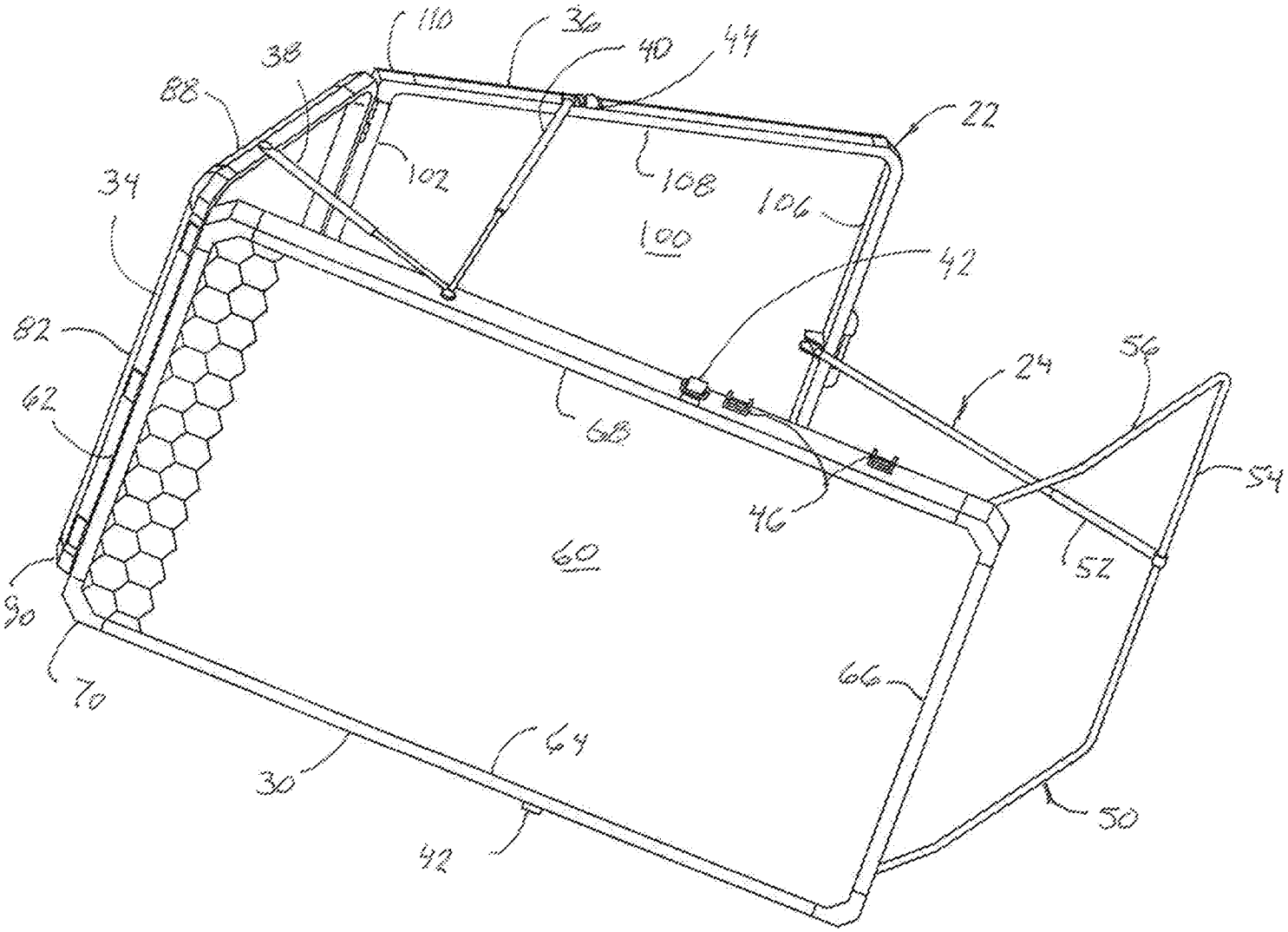
FIG. 3 is an alternative perspective of the rooftop tent without the fabric enclosure.
Figure 4:
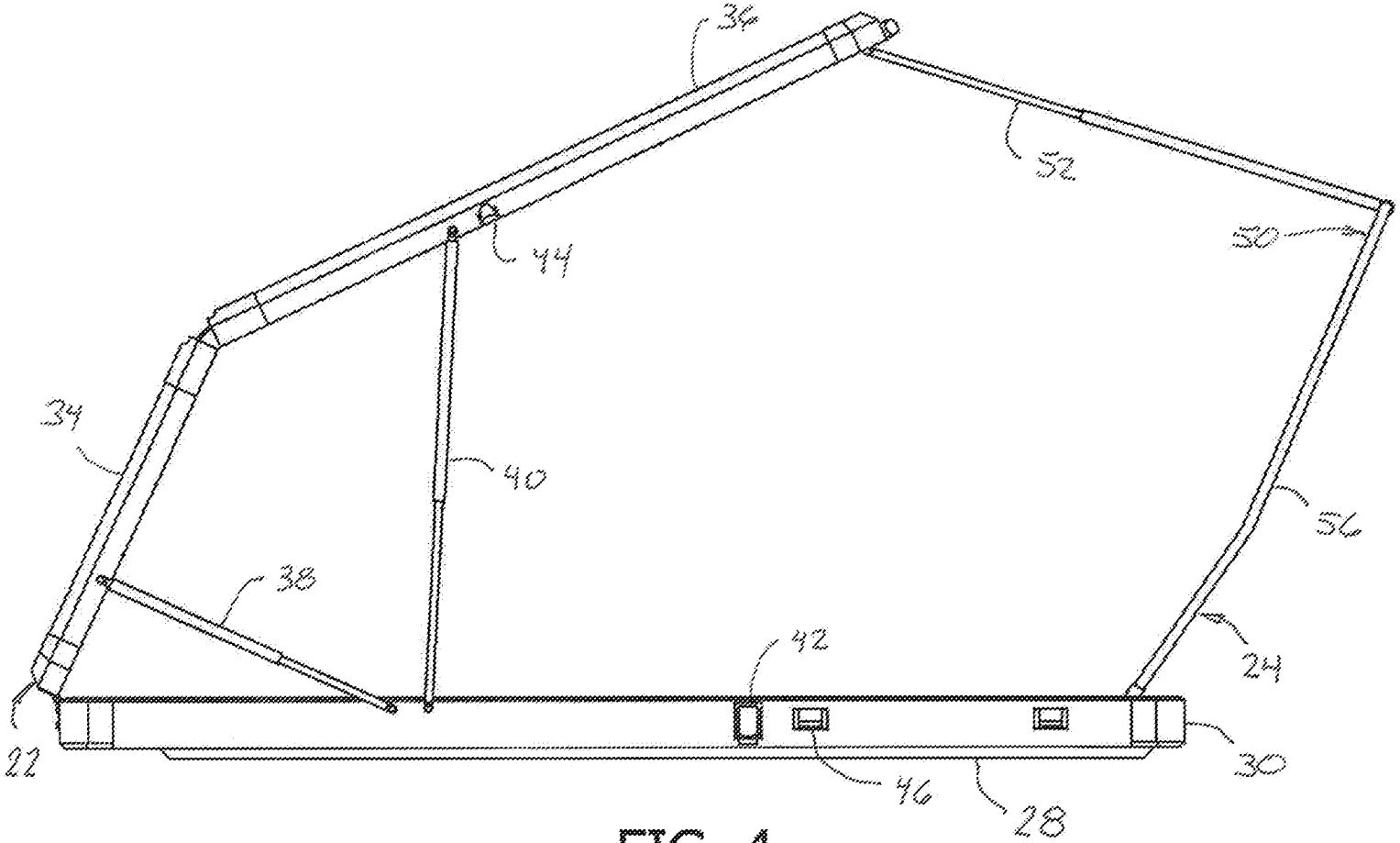
FIG. 4 is an elevation the rooftop tent shown with base stiffeners and without a fabric enclosure.

As shown in FIGS. 1-4, an example of a hard shell rooftop tent assembly (broadly, a hard shell rooftop shelter assembly) is designated in its entirety by reference number 20. The tent assembly 20 comprises a hard shell container, generally designated by 22, a frame assembly, generally designated by 24 (FIG. 2), and a fabric enclosure (broadly, a flexible sheet or tent material enclosure), generally designated by 26. FIGS. 2 and 3 illustrate the rooftop tent assembly 20 without the fabric enclosure 26. FIG. 4 illustrates the tent assembly 20 with base stiffeners 28 for spanning crossbars (not shown) of a conventional vehicle roof rack. As will be appreciated, the base stiffeners 28 strengthen a corresponding portion of the hard shell container 22.

As illustrated in FIGS. 1-4, the hard shell container 22 comprises a base or platform 30 and a hard shell top, generally designated by 32. The hard shell top 32 includes a rigid lower side panel (broadly, a rigid wall) 34 and a rigid upper roof panel (broadly, a rigid roof) 36. A pair of shorter gas springs or struts 38 extend between the base 30 and the lower side panel 34 and a pair of longer gas springs or struts 40 extend between the base and the roof panel 36 to assist in raising the top 32 to its opened or deployed configuration as shown. The gas springs 38, 40 also control the top 32 when dismantling the tent so the top is in its closed or stowed configuration. The gas springs 38, 40 are chosen to support most of the weight of the top 32 and the fabric enclosure 26 in the open configuration but allow the tent assembly to be moved to its closed configuration with little effort once the frame assembly 24 is disconnected from the hard shell top 32 as will be explained. Locking clasp connectors 42, 44 are mounted on each side of the base 30 and roof panel 36, respectively for securing the tent assembly 20 in the closed configuration. Further, a pair of ladder connectors 46 are mounted on the base 30 for connecting a conventional ladder (not shown) to the tent assembly 20 to steady the ladder when climbing into and out of the tent assembly. As shown in FIGS. 2-4, the frame assembly 24 comprises an arched support, generally designated by 50, and a ridge support or spacer 52 that selectively connects to the roof panel 36. The illustrated arched support 50 comprises a generally horizontal upper section 54 and a pair of side sections 56 extending from opposite ends of the upper section to the base 30. The lower end of each side section 56 is pivotably connected to the base 30 such that when the spacer 52 is disconnected from the upper panel 36, the arched support 50 is free to pivot downward toward the base. In the illustrated example, the spacer 52 is pivotably attached to the upper section 54 of the arched support 50, allowing the spacer to rotate to a position generally parallel to the side sections 56 of the arched support when the arched support is lowered. As further shown in FIGS. 2 and 3, the illustrated base 30 comprises a generally flat and rigid panel 60 surrounded by rim sections 62, 64, 66, 68 joined by corner joints 70. The illustrated lower panel 34 having a generally flat and rigid panel 80 surrounded by edge members 82, 84, 86, 88 joined by corner joints 90. The panel 80 of the illustrated example has a construction similar to the base panel 60 but has a thinner overall thickness. The upper panel 36 includes a flat and rigid panel 100. The panel 100 is surrounded by end and side members 102, 104, 106, 108 having constructions similar to the edge members 82, 84, 86, 88 of the lower panel 34. Further, the end and side members 102, 104, 106, 108 of the illustrated example are joined by corner joints 110 having constructions similarly to the corner joints 90 of the lower panel 34.

Figure 5:
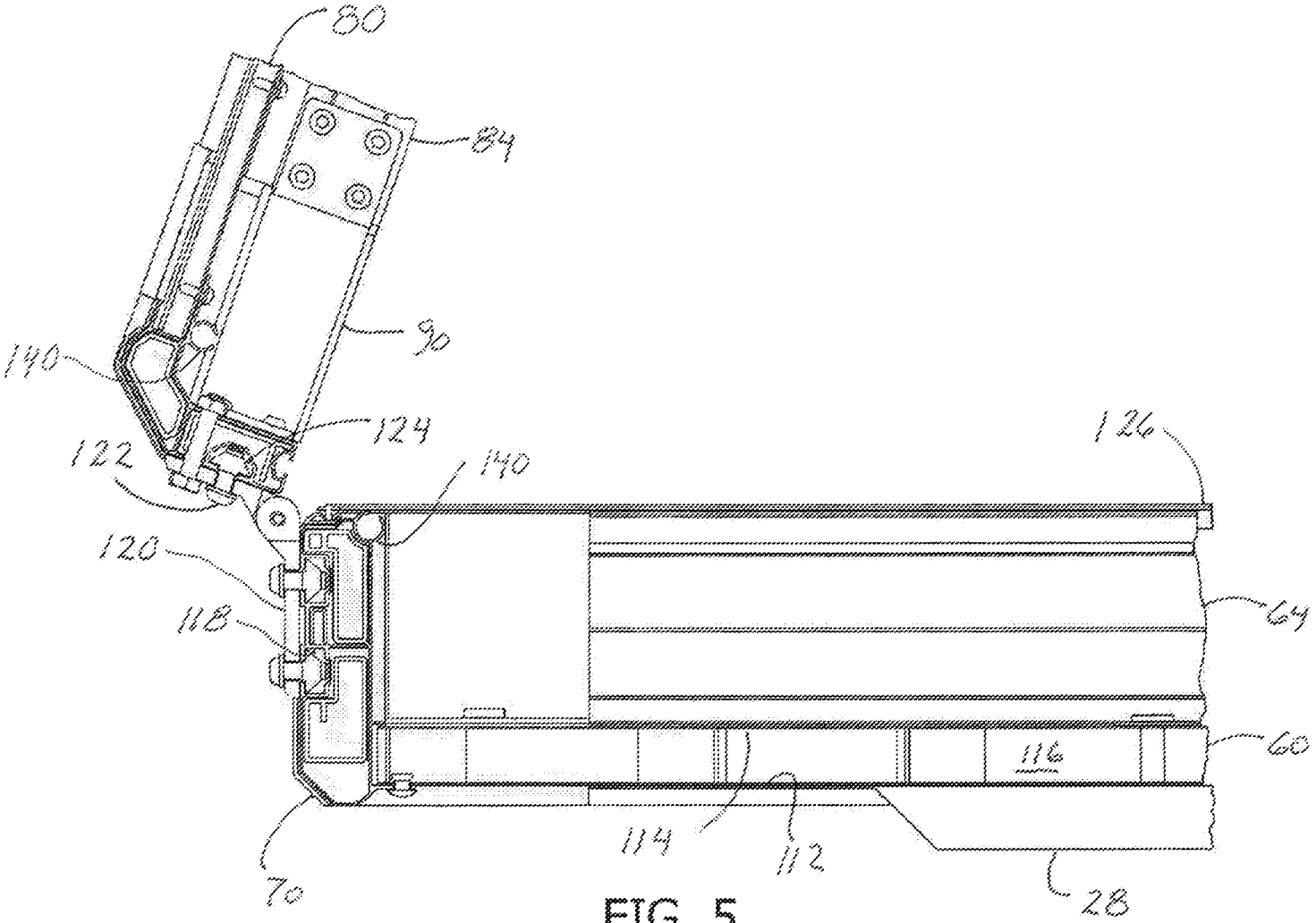
FIG. 5 fragmentary cross section of FIG. 4 showing a joint between the base a rigid lower side panel.
Figure 6:
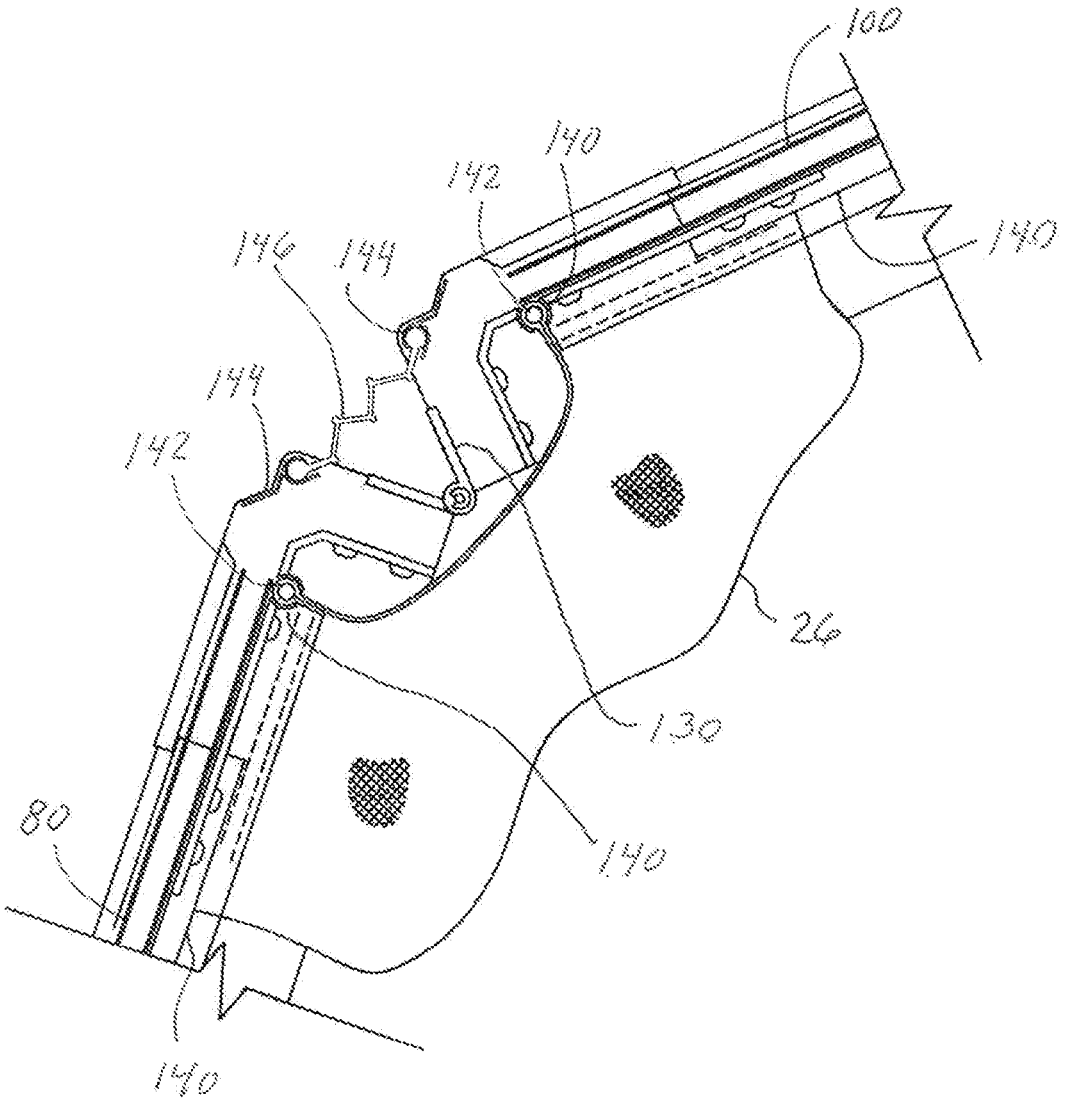
FIG. 6 is fragmentary cross section of FIG. 4 showing a joint between the rigid lower side panel and a rigid upper roof panel.

As shown in FIG. 5, the illustrated base panel 60 is formed from sheets 112, 114 spaced by a honeycomb structure 116. Although the rim sections may be made from other suitable materials, the illustrated rim sections 62, 64, 66, 68 are extruded aluminum channels having one or more slots 118 adapted to receive T-fasteners. The illustrated corner joints 70 are molded or 3-D printed and joined to the rim sections 62, 64, 66, 68 using conventional screw fasteners or rivets. As shown in FIGS. 5 and 6, the lower panel 34 and upper panel 36 constructions are similar to the base except that the specific shapes of the constituent parts are different as shown. For example, panels 80, 100 are thinner than the panel 60 of the base 30. Further, the extruded portions of the lower panel 34 and upper panel 36 have a shorter height than the rim sections 62, 64, 66, 68 of the base 30. Likewise, the corner joints 90, 110 of the lower panel 34 and upper panel 36 have shorter heights than the corner joints 70 of the base 30. As further illustrated in FIG. 5, the base 30 and lower panel 34 are pivotally connected by conventional hinges 120 fastened to the corresponding rim section 62 and edge member 82. The hinges 120 are fastened to the rim section 62 and edge member 82 using screw fasteners 122 threaded into T-nuts 124 positioned inside the slots 118 of the rim section and edge member. An elastomeric seal 126 is provided around the top edges of the rim sections 62, 64, 66, 68 and corner joints 70 to seal an interface between the base 30 and top 32 when the tent assembly is closed.

As shown in FIG. 6, the lower panel 34 are upper panel 36 are pivotally connected by conventional hinges 130 fastened to the corresponding edge member 86 and end member 102 using screw fasteners threaded into T-nuts (not shown) positioned inside the slots 118 of the end member and edge member. Examples of slotted cylindrical channels 140 formed in the extruded rim sections, 62, 64, 66, 68, edge members 82, 84, 86, 88, and side members 102, 104, 106, 108 are shown in FIG. 6. The channels 140 receive corresponding edges of the fabric enclosure 26 having cording 142 to join the enclosure to the panels 30, 32, 34 as shown. Additional slotted cylindrical channel connectors 144 are provided above the hinges 120 for receiving a flexible pleated seal or gasket 146 that prevents water from passing through the joint.

Figure 7:
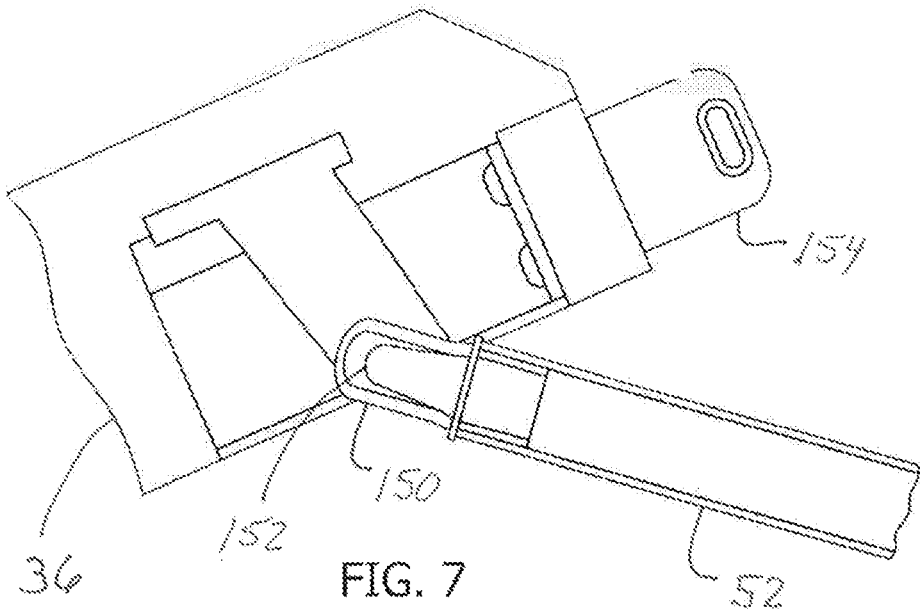
FIG. 7 is fragmentary schematic cross section of FIG. 4 showing a connection between the rigid upper roof panel and a portion of a frame assembly.

FIG. 7 illustrates a socket connector 150 that is mounted inside the upper panel 36 for slidably receiving a fitting 152 mounted on an end of the ridge support 52. The connector 150 and fitting 152 allow the ridge support 52 to be connected to the upper panel 36 when the tent assembly 20 is opened. The connector 150 and fitting 152 permit the ridge support 52 to be separated from the upper panel 36 when the tent assembly 20 is closed. A handle 154 is fastened to the upper panel 36 as shown for a user to grasp when opening and closing the tent assembly 20.

Figure 8:
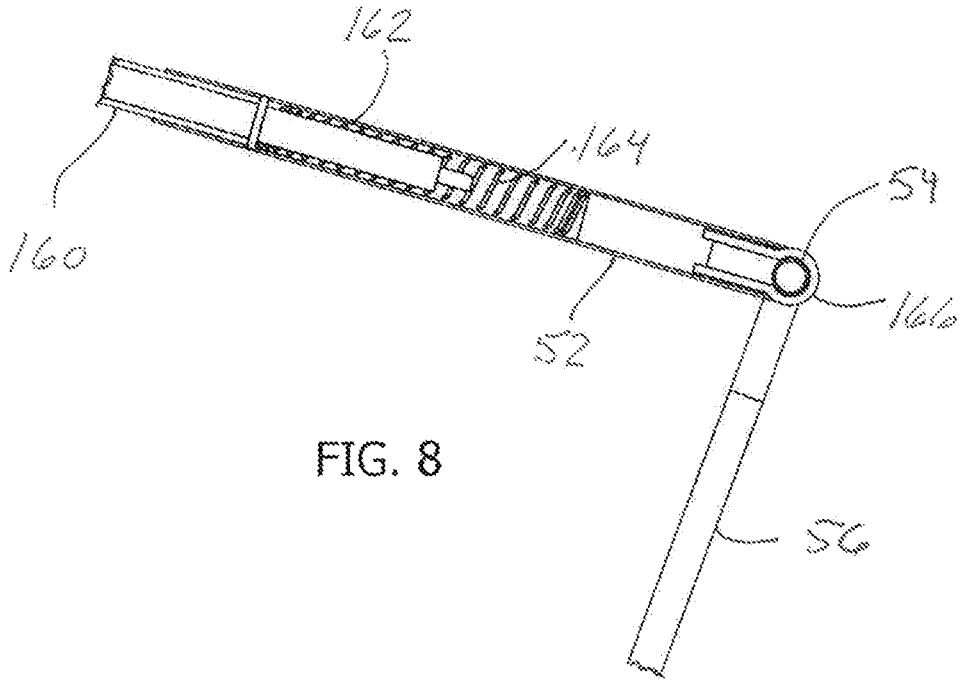
FIG. 8 is a fragmentary cross section of FIG. 4 showing a detail of the frame assembly.
Figure 9:
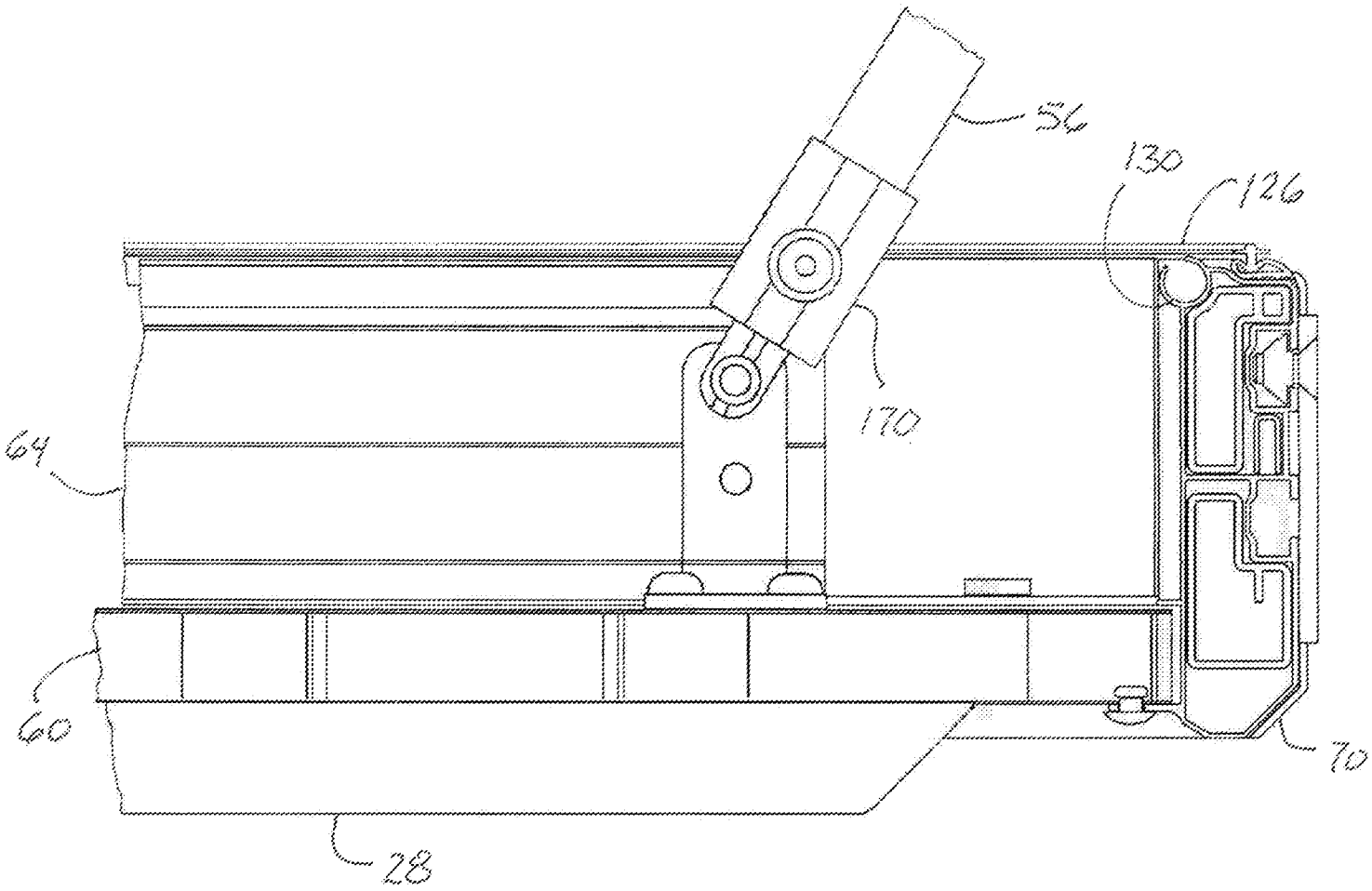
FIG. 9 is a fragmentary schematic cross section of FIG. 4 showing a connection between the frame assembly and the base.

FIG. 8 shows a detail of the ridge support 52. The ridge support 52 is formed from telescoping tubes 160, 162. A spring mechanism 164 biases the tubes 160, 162 toward an extended position to ensure the fitting 152 of the ridge support 52 remains in the socket connector 150. A rotatable coupling 166 connects the ridge support 52 to the upper section 54 of the arched support 50 allowing the ridge support to pivot around the upper section as the tent assembly is opened and closed. As shown in FIG. 9, the lower ends of the side sections 56 of the arched support 50 are mounted on pivoting connectors 170 that are fastened to the base 30 as shown.

Figure 10:
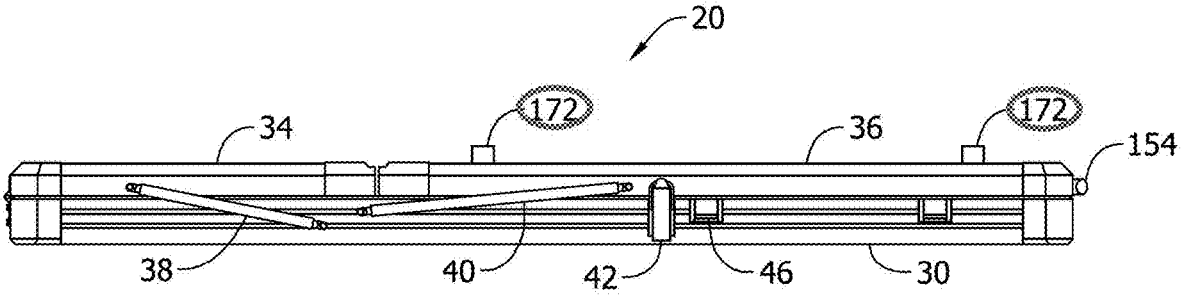
FIG. 10 is an elevation of the rooftop tent shown with an optional rack in a fully closed configuration for travel or storage.
Figure 11:
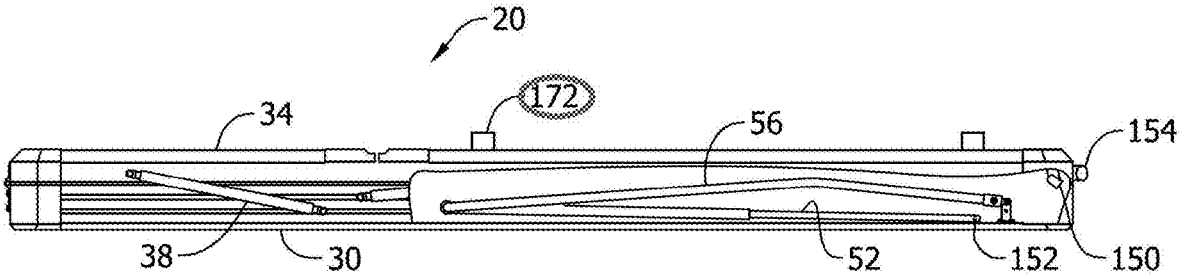
FIG. 11 is fragmentary elevation of the rooftop tent of FIG. 10 showing the frame assembly in the fully closed configuration.

FIGS. 10 and 11 illustrate the tent assembly 20 in which an optional rack 172 is mounted on the upper panel 36 for supporting luggage and equipment (not shown) when the assembly is in a closed configuration as shown. When in the closed configuration, the hard shell top 32 is lowered and fastened to the base 30. FIG. 11 shows the frame assembly 24 in its stowed configuration in which the arched support 50 is pivoted downward to rest adjacent the base 30 and the ridge support 52 is rotated relative to the arched support 50 to rest adjacent the base.

Returning to FIG. 1, the tent assembly 20 and in particular the fabric encloser 26 may include various conventional features, such as doorways 180 having zippered fabric doors 182. Straps 184 may be provided to hold the doors 182 when open. Further, the doors may include screens (not shown). The enclosure may also include transparent windows 186 to allow light into the enclosure. Batten pockets 190 may be provided for receiving battens (not shown) to reduce movement of the fabric enclosure 26 in wind and guide the enclosure into the hard shell 22 when closing the tent assembly. In addition, vents 192 may be provided in the enclosure 26. A skirt 194 may be formed around the base 30 to shed water outside the base. Still further, an optional cargo net 196, light (not shown), and other conveniences may be mounted inside the enclosure 26.

The tent assembly 20 is intended to be mounted on a carrier (not shown) such as a conventional vehicle carrier. When not in use or during travel the hard shell 22 is lowered onto the base 30 and locked in place. When opening the tent assembly, a user unlocks the clasp connectors 42, 44, grasps the handle 154 and lifts the hard shell 22. The gas springs 38, 40 assist the user in lifting the hard shell 22 so the lower panel 34 and upper panel are positioned as shown in FIG. 4. The fabric enclosure 26 rises with the hard shell 22. Once in the position shown in FIG. 4, the user reaches through a convenience doorway 180 to pivot the arched support 50 upward and rotate the ridge support 52 to align the fitting 152 on the free end of the support with the socket connector 150 mounted on the upper panel 36. The user compresses the spring mechanism 164 inside the telescoping ridge support 52 to insert the fitting 152 in the socket connector 150. The tent assembly is now in its open configuration as shown in FIG. 1. To close the tent assembly 20, the user reverses the steps required to open the assembly. The battens in the enclosure act to guide the enclosure inside the base 30 as the hard case is lowered. By guiding the fabric into the hard shell container 22, closing the tent 20 is significantly faster than conventional wedge-shaped and box-shaped tents.

In contrast to wedge-shaped designs, the side panel 34 spaces the hinged end of the roof panel 36 from the base 30 when the tent assembly 20 opens. Accordingly, the side panel 34 eliminates wasted space where the top 32 meets the base 30. Thus, the tent assembly 20 provides more livable space than found in wedge-shaped tent designs. In addition, the side panel 34 provides increased protection from weather compared to the box-shaped tent designs.

When introducing elements in this description and the claims, the articles "a", "an", "the", and "said" are intended to indicate one or more of the elements. The terms "comprising", "including", and "having" are intended to be inclusive and indicate there may be additional elements other than the listed elements.

As those skilled in the art could make various changes to the above constructions, products, and methods without departing from the intended scope of the description, all matter in the above description and accompanying drawings should be interpreted as illustrative and not in a limiting sense. The patentable scope of the disclosure is defined by the claims, and can include other constructions and methods that would occur to those skilled in the art. Such other constructions are intended to be within the scope of the claims if the structural elements of the constructions do not differ from the literal language of the claims, or if the constructions include equivalent structural elements having insubstantial differences from the literal languages of the claims.

To the extent that the specification, including the claims and accompanying drawings, discloses any additional subject matter that is not within the scope of the claims below, the disclosures are not dedicated to the public and the right to file one or more applications to claims such additional disclosures is reserved.

The invention claimed is:

1. A shelter assembly, comprising:

a rigid, generally flat base having a first rim section, a second rim section opposite said first rim section, and opposite side rim sections extending between said first rim section and said second rim section;

a rigid lower panel having a lower edge, an upper edge opposite said lower edge, and opposite side edges extending between the lower edge and the upper edge, said lower edge being pivotably connected to the first rim section of the base for movement between a closed orientation in which the upper edge is positioned adjacent to the base and an open orientation in which the upper edge is spaced from the base;

a rigid upper panel having a first end, a second end opposite said first end, and opposite sides extending between said first end and said second end, said first end being pivotably connected to the upper edge of the lower panel for pivoting movement relative to the lower panel between a closed configuration in which the upper panel and the lower panel are generally coplanar and an open configuration in which the upper panel is oriented at an angle of less than about 180 degrees relative to the lower panel; and a pair of flexible side panels, each flexible side panel of said pair of flexible side panels comprising flexible tent material and extending between a flexible lower edge attached directly to one side edge of the pair of side edges of the lower panel, a flexible upper edge attached directly to one side of the pair of sides of the upper panel corresponding to said one side edge of the lower panel, and a flexible bottom edge attached directly to one side rim section of the pair of side rim sections corresponding to said one side edge of the lower panel and said one side of the upper panel.

2. The shelter assembly as set forth in claim 1, further comprising an end panel extending between the second end of the upper panel, the second rim section of the base and the pair of side panels.

3. The shelter assembly as set forth in claim 2, wherein the end panel comprises foldable tent material.

4. The shelter assembly as set forth in claim 2, further comprising a support positionable to extend upward from the base for supporting the end panel when the lower panel is in the open orientation.

5. The shelter assembly as set forth in claim 4, wherein the support comprises an upper section and a pair of side sections extending from opposite ends of the upper section.

6. The shelter assembly as set forth in claim 5, wherein each side section of said pair of side sections is pivotably connected to the base for movement between a lowered position in which the upper section is positioned adjacent to the base and a raised position in which the upper section is spaced from the base.

7. The shelter assembly as set forth in claim 6, further comprising a spacer extending between the upper section of the support and the upper panel.

8. The shelter assembly as set forth in claim 7, wherein the spacer has a selectively variable length.

9. The shelter assembly as set forth in claim 8, wherein the spacer is pivotably connected to the upper section of the support.

10. The shelter assembly as set forth in claim 7, wherein the spacer is longitudinally compressible and includes a spring for biasing the spacer toward an extended length.

11. The shelter assembly as set forth in claim 2, further comprising a pair of struts extending between the base and the lower panel for holding the lower panel in its open orientation.

12. The shelter assembly as set forth in claim 11, wherein:

said pair of struts is a first pair of struts; and the shelter assembly further comprises a second pair of struts extending between the base and the upper panel for holding the upper panel in its open configuration.

13. The shelter assembly as set forth in claim 12, wherein said first pair of struts and said second pair of struts comprise gas springs.

14. The shelter assembly as set forth in claim 1, wherein the base is adapted for mounting on a vehicle top carrier.

15. A shelter assembly, comprising:

a rigid, generally flat base having a first rim section, a second rim section opposite said first rim section, and opposite side rim sections extending between said first rim section and said second rim section;

a rigid wall having a lower edge, an upper edge opposite said lower edge, and opposite side edges extending between the lower edge and the upper edge, said lower edge being pivotably connected to the first rim section of the base for movement between a closed orientation in which the upper edge is positioned adjacent to the base and an open orientation in which the upper edge is spaced from the base;

a rigid roof having a first end, a second end opposite said first end, and opposite sides extending between said first end and said second end, said first end being pivotably connected to the upper edge of the wall for pivoting movement relative to the wall between a closed configuration in which the roof and the wall are generally coplanar and an open configuration in which the second end of the roof is spaced from the base;

a pair of side panels comprising tent material, each side panel of said pair of side panels extending between one side edge of the pair of side edges of the wall, one side of the pair of sides of the roof corresponding to said one side edge of the wall, and one side rim section of the pair of side rim sections corresponding to said one side edge of the wall and said one side of the roof; and an end panel comprising tent material, said end panel extending between a flexible upper edge attached to the second end of the roof, a flexible bottom edge attached to the second rim section of the base and flexible lower edges attached to the pair of side panels.

16. A shelter assembly, comprising:

a rigid, generally flat base having a first rim section, a second rim section opposite said first rim section, and opposite side rim sections extending between said first rim section and said second rim section, said first rim section, said second rim section, and said opposite side rim sections having equal and uniform heights;

a rigid wall having a lower edge, an upper edge opposite said lower edge, and opposite side edges extending between the lower edge and the upper edge, said lower edge being pivotably connected to the first rim section of the base for movement between a closed orientation in which the upper edge is positioned adjacent the base and an open orientation in which the upper edge is spaced from the base;

a rigid roof having a first end, a second end opposite said first end, and opposite sides extending between said first end and said second end, said first end being pivotably connected to the upper edge of the wall for pivoting movement relative to the wall between a closed configuration in which the roof and the wall are generally coplanar and an open configuration in which the first end of the roof is elevated above the base by a first distance and the second end of the roof is elevated above the base by a second distance; and a pair of flexible side panels, each flexible side panel of said pair of side panels extending between one side edge of the pair of side edges of the wall, one side of the pair of sides of the roof corresponding to said one side edge of the wall, and one side rim section of the pair of side rim sections corresponding to said one side edge of the wall and said one side of the roof.

17. The shelter assembly as set forth in claim 16, wherein the second distance is different than the first distance.

18. The shelter assembly as set forth in claim 17, wherein the second distance is greater than the first distance.

19. The shelter assembly as set forth in claim 16, further comprising an end panel extending between the second end of the roof, the second rim section of the base and the pair of side panels.

20. The shelter assembly as set forth in claim 19, the pair of side panels and the end panel comprise flexible tent material.

* * * * *